United States Patent [19]

Stein

[11] Patent Number: 4,804,082

[45] Date of Patent: Feb. 14, 1989

[54] SECURITY BOX HAVING SLIDING CLOSURE

[75] Inventor: Eric D. Stein, Cincinnati, Ohio

[73] Assignee: Buckhorn, Inc., Milford, Ohio

[21] Appl. No.: 35,994

[22] Filed: Apr. 8, 1987

[51] Int. Cl.[4] ..... A45C 13/10; A45C 13/18

[52] U.S. Cl. ..... 206/1.5; 206/807; 220/214; 220/315

[58] Field of Search ..... 206/807, 387, 1.5, 459; 220/214, 265, 315

[56] References Cited

U.S. PATENT DOCUMENTS

| | | | |
|---|---|---|---|
| 4,381,836 | 5/1983 | Rivkin et al. | 206/807 |
| 4,610,371 | 9/1986 | Karkiewicz | 206/807 |
| 4,658,955 | 4/1987 | Eichner | 206/807 |
| 4,711,372 | 12/1987 | Gach | 206/807 |

*Primary Examiner*—Joseph Man-Fu Moy

*Attorney, Agent, or Firm*—Fay, Sharpe, Beall, Fagan, Minnich & McKee

[57] ABSTRACT

A document tray is provided with a plurality of interior partitions having a wedging connection with hollow buttresses of the container wall. The transparent lid is provided with hooks at its rear end for engaging within correspondingly shaped apertures of the rear end wall of the container, and hooks at its front end for engaging within corresponding shaped apertures within the container front end wall. Security ties tightly lock the lid and container together at the rear end wall. The hooks at the front end wall are provided with notch sensitive areas that provide weakened portions such that the hooks will break off prior to any successful tampering with the front hook aperture connection.

13 Claims, 5 Drawing Sheets

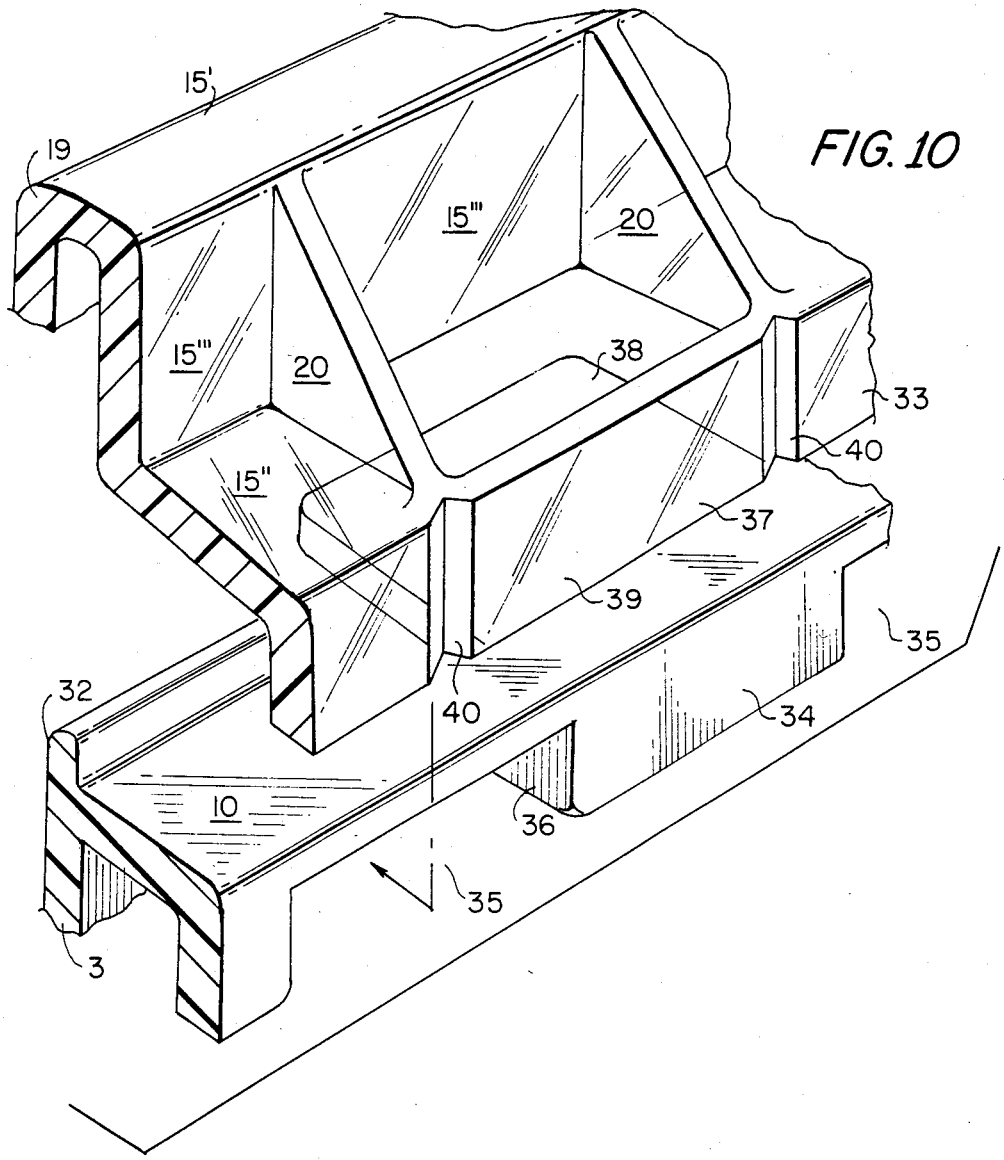
FIG. 10
FIG. 11
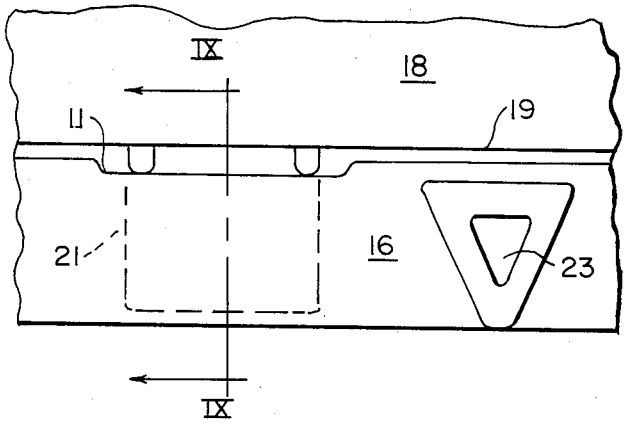

SECURITY BOX HAVING SLIDING CLOSURE

BACKGROUND OF THE INVENTION

The present invention is an improvement over U.S. Pat. No. 4,405,057 issued Sept. 20, 1983 and U.S. Pat. No. 4,470,518 issued Sept. 11, 1984, each to Eric D. Stein, the disclosure of which patents is incorporated herein.

The boxes of the above patents serve very well for the storing, transporting and selective viewing of papers, particularly bank related papers. At times, such boxes are used with respect to currency. Security is an essential item.

These boxes are not "strong boxes" or safes, but they are still security boxes. By this, it is meant that the lid is securely held to the bottom so that the security tie (strap, lock, etc.) cannot be temporarily removed, but must be destroyed to remove the lid; if it is, this is easily seen and it is then known at what point in the transit that security was compromised. This discourages or eliminates pilfering.

SUMMARY OF THE INVENTION

It has been found that pilfering has been experienced with respect to these boxes without breaking the security tie, strap or lock. Thus, the point during transit or storage where the security breach occurred cannot be discovered.

It has been determined that it is possible to unzip or disengage the end hooks or tabs, such as the hook 51 in U.S. Pat. No. 4,470,518, particularly with the use of a screwdriver or like tool. After these hooks have been disengaged, documents, particularly currency, can be removed from the security box. Thereafter, by forcing the portions together, the hooks re-engage or zip-up, and there is no evidence of the pilfering when viewing the closed box.

With weakened or notch sensitive areas for the end hooks or tabs, any substantial attempt at disengaging the hooks or tabs by unzipping them, that is disengaging them without removing or destroying the security tie or the like, would result in the hook or tab breaking off. While this will not prevent removal of the lid and in fact make it easier to gain access to the box, any unauthorized access to the box will be easily noticed and the point in time or place where access occurred will then be easily noticed, which will result in apprehension or discouragement of pilfering. Therefore, the weakened or notch sensitive areas for the hooks or tabs is an effective security measurement and should reduce or eliminate the above mentioned problems of pilfering for this type of box.

BRIEF DESCRIPTION OF THE DRAWINGS

FIG. 10 is a partial perspective view, exploded to show assembly in the area B of FIG. 1;

FIG. 11 is an enlarged portion of FIG. 5 at A;

DETAILED DESCRIPTION OF A PREFERRED EMBODIMENT

THE BASIC STRUCTURE

Figure 1:
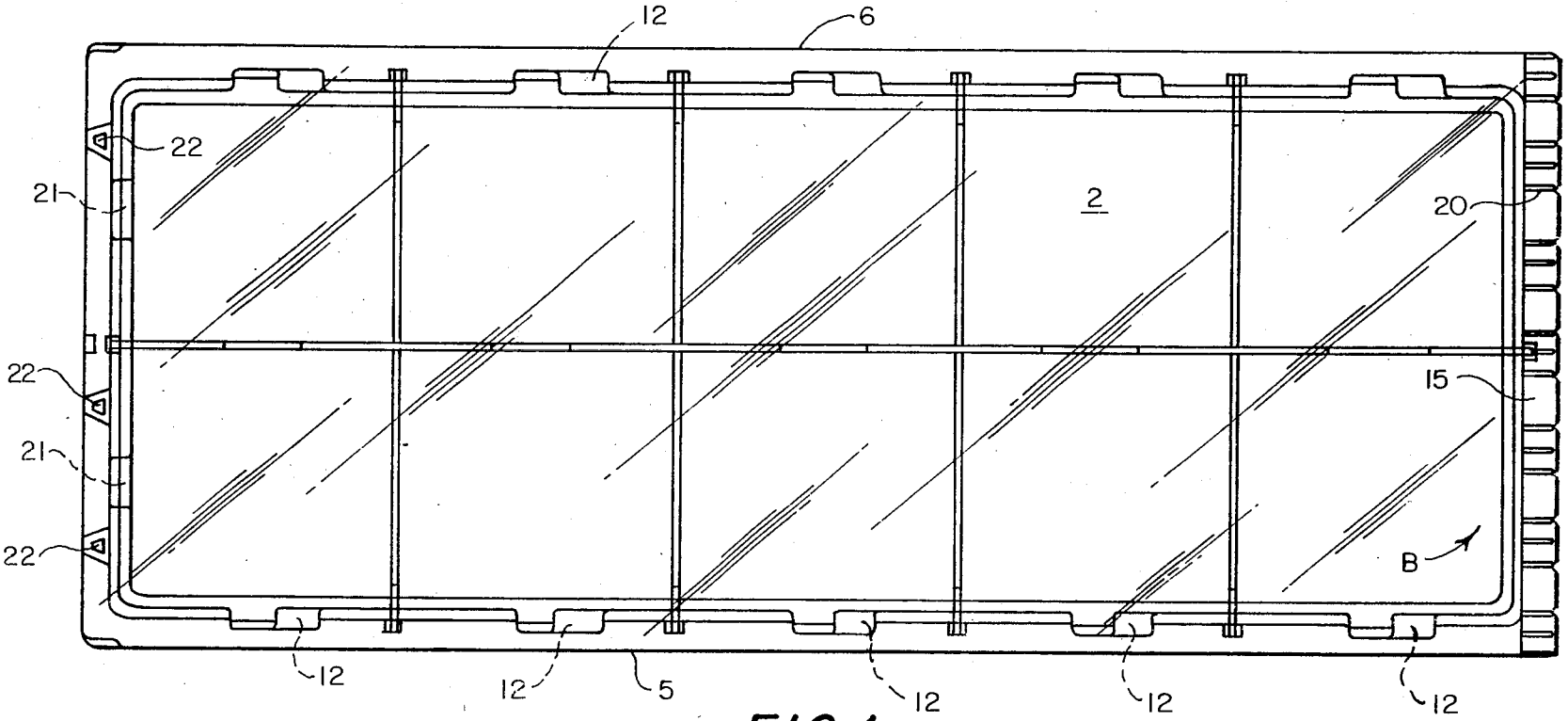
FIG. 1 is a top plan view of the preferred embodiment.
Figure 2:
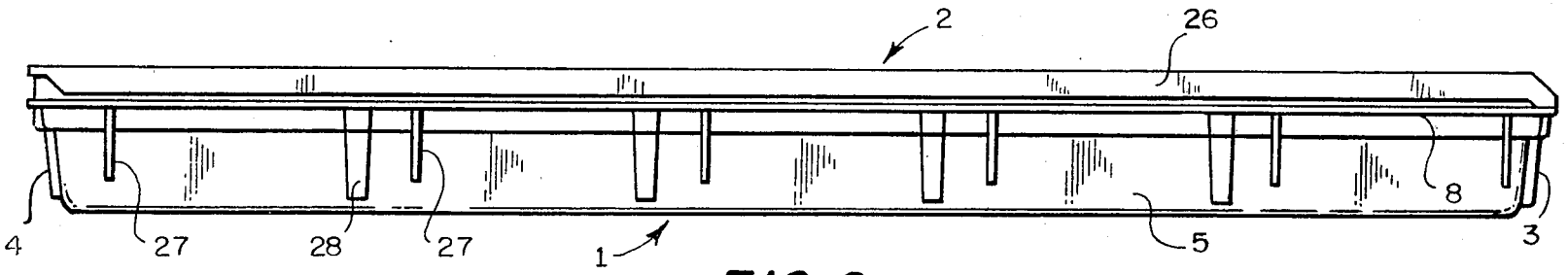
FIG. 2 is a side elevational view thereof.
Figure 3:
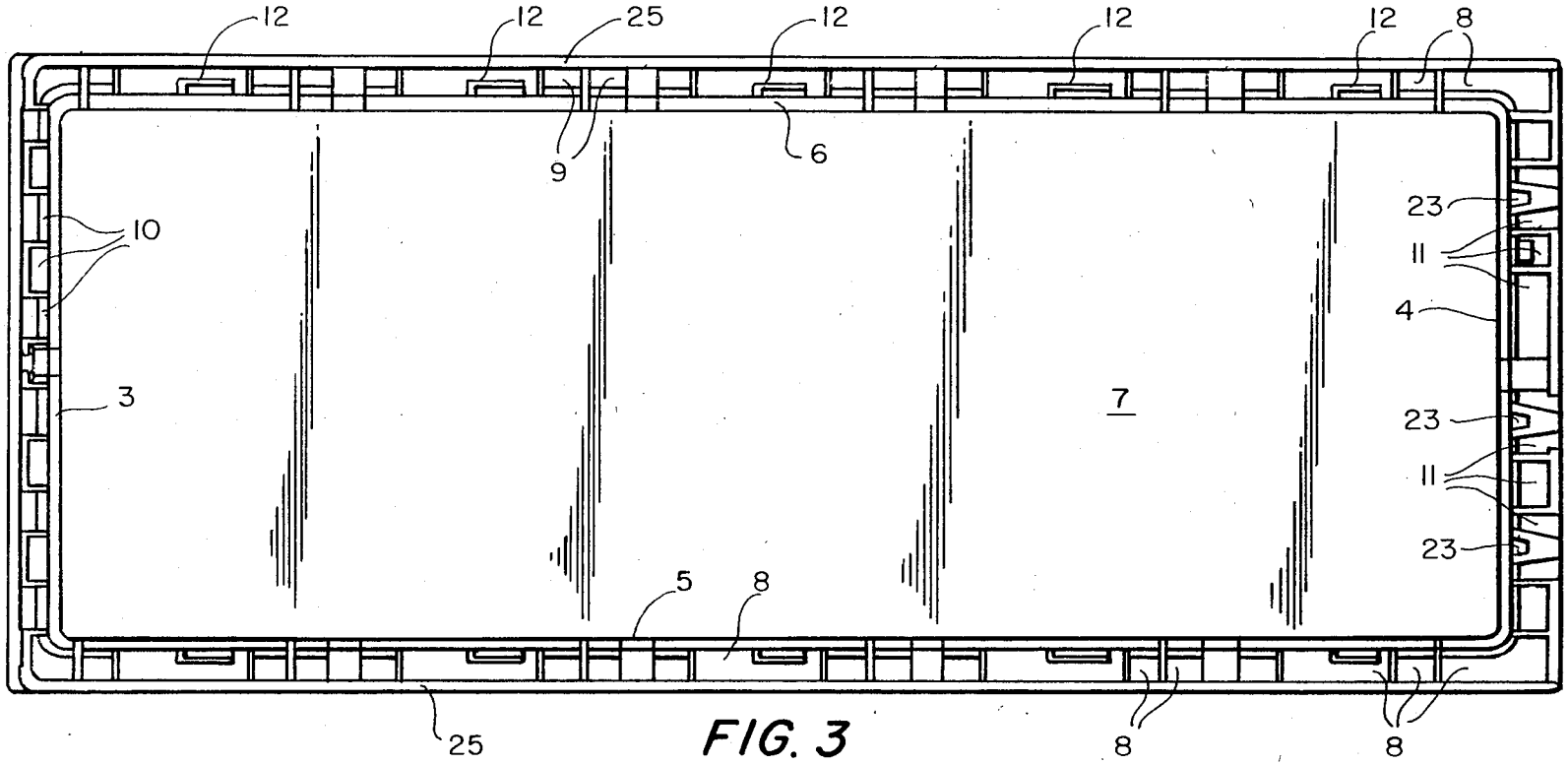
FIG. 3 is a bottom view thereof.
Figure 4:
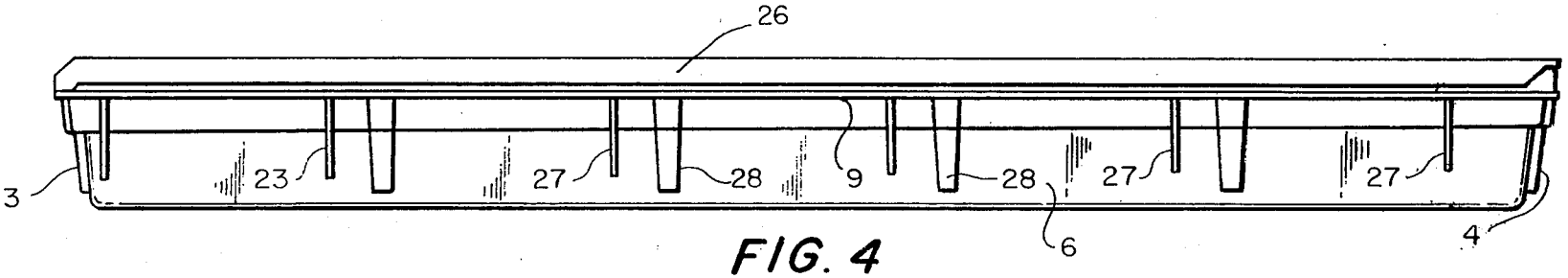
FIG. 4 is a side elevational view opposite from that of FIG. 2.
Figure 5:
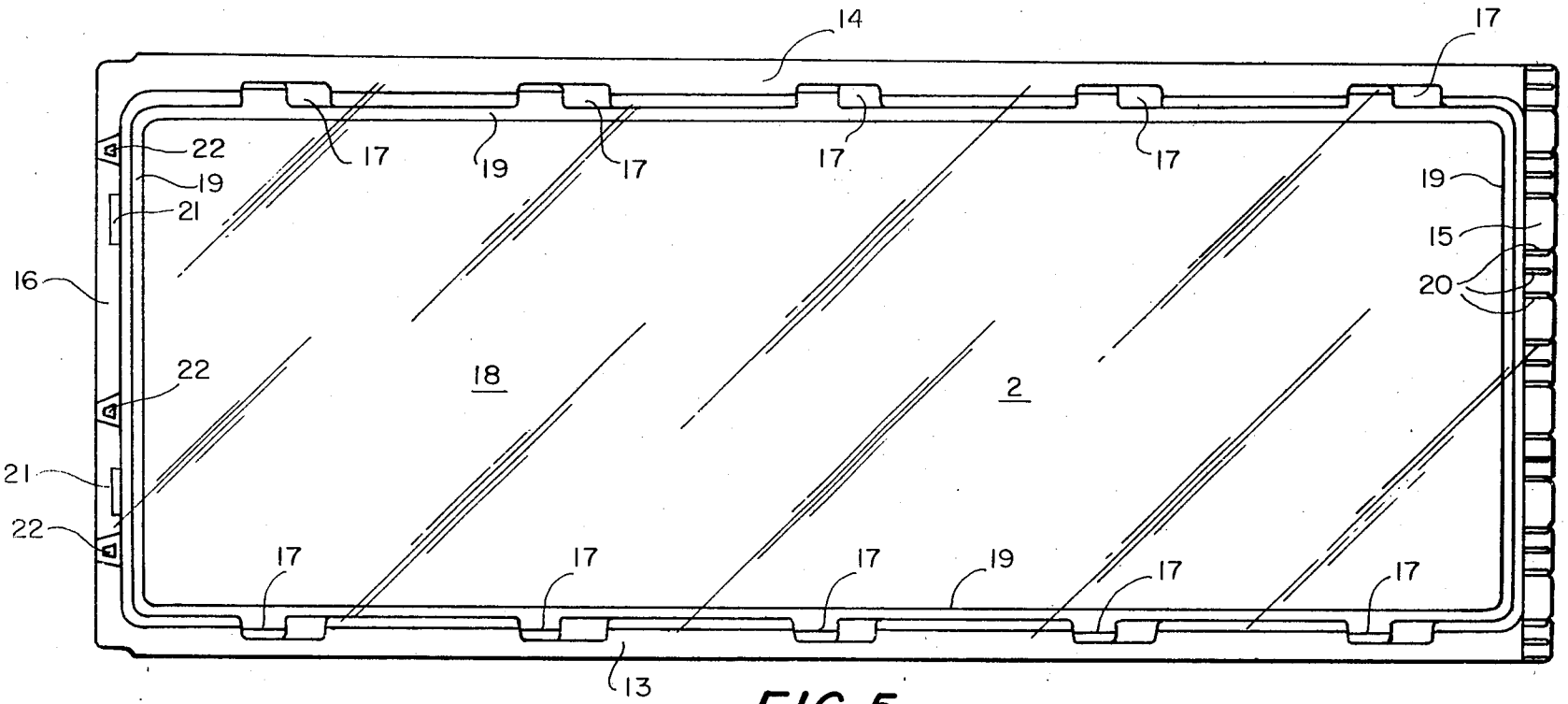
FIG. 5 is a top plan view of the lid.
Figure 7:
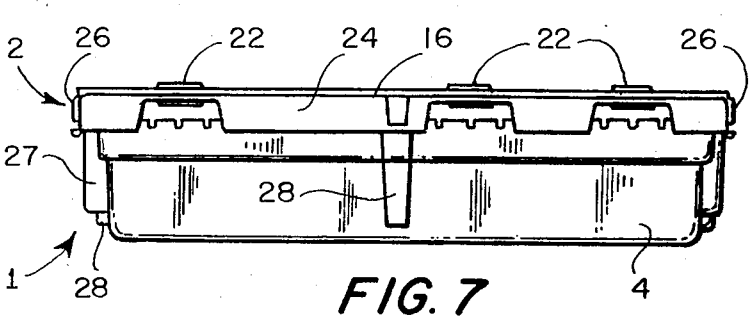
FIG. 7 is an end elevational view opposite that of view 6.
Figure 6:
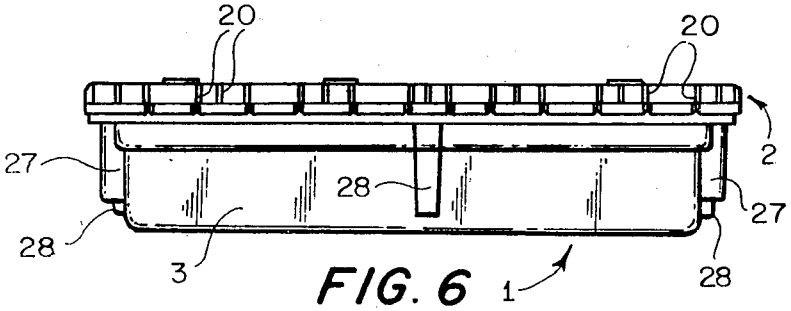
FIG. 6 is an end elevational view.

Since the security storage box of the present preferred embodiment is an improvement of that shown in the above-mentioned patents, whose disclosure is incorporated herein in its entirety, the features will be only mentioned briefly. For more details of the basic structure, reference is made to such patents.

The security storage box is designed to be used by commercial paper establishments, such as banks, for the storage, sorting, viewing and transport of financial papers, for example, checks and/or currency. The box is composed of only two parts, namely a one piece molded synthetic resin open topped container 1 and a separate integrally molded one piece synthetic resin 2. The container has opposed generally parallel and rectangular end walls 3, 4, opposed generally parallel side walls 5, 6, and a rectangular bottom wall 7.

The upper edge portions of the side walls 5, 6 and the end walls 3, 4 include integrally formed outwardly extending horizontal flanges 8, 9, 10, 11, respectively, that are connected together around substantially the entire upper periphery of the container, thus forming the container side flanges 8, 9 and container end flanges 10, 11. The container side flanges 8, 9 have a plurality of through container apertures, particularly five on each side. Even though the lid in FIG. 1 completely covers the container, the lid is constructed of transparent material so that the structure of the container beneath is visable. The lid is of a size and rectangular shape to close the open top of the container.

The lid has a lid flange or more particularly four lid flanges 13, 14, 15, 16 that are horizontal and respectively overlie the flanges 8, 9, 10, 11 of the container. The lid is also provided with a plurality of lid side hooks 17 downwardly depending in one piece in alignment with the respective aperture. These hooks 17 extend through each of the container apertures 12. The lid side hooks 17 and through container apertures 12 are of such a size and shape so that in a disengaged position, the hooks 17 are vertically spaced above the apertures 12. From this disengaged position (not shown), the lid 2 may be translated vertically downward to a closed position on the container 1 with the lid side hooks 17 extending completely through the container apertures 12. This closed position is also not shown in the drawings. From the closed position, the lid may be translated horizontally parallel to the side walls toward the end wall 4 to engage the lid side hooks 17 beneath the container flanges 8, 9 to assume the locked position that is shown in FIGS. 1, 2, 3, 4, 5, 6, 7, 8, 9 and 11.

The lid preferably is provided with a recessed planar main central portion 18, and peripheral vertical flanges 19 extending upwardly from the main portion 18, with the upper part of the vertical flanges 19 being integrally connected with the horizontal flanges 13, 14, 15, 16. The detailed description above with respect to the preferred embodiment equally applies to the abovementioned patents.

At the front end of the lid, the flange 15 has an upper horizontal portion 15', FIG. 10, which is in the same plane as flanges 13, 14 and 16. Portion 15' is connected to lower horizontal portion by a vertical flange 15'''. Container flange 10 is below flanges 8, 9, 11 by a corresponding amount. Triangular shaped vertically extending buttresses 20 are provided between the outer surface of the flange 15''' and the outside surface of the flange 15'', for reinforcement purposes. Particularly, these buttresses prevent the flange 15'' from being bent upwardly, for security reasons.

Figure 9:
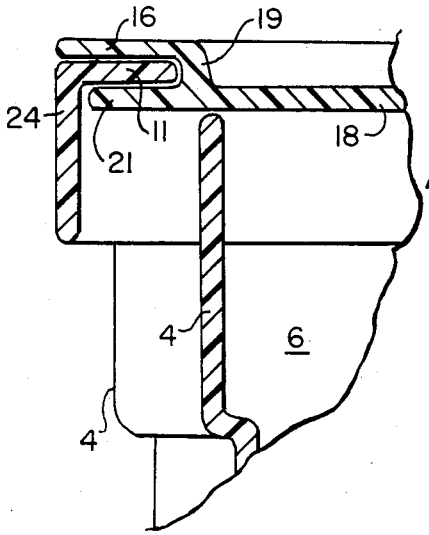
FIG. 9 is a partial cross-sectional view taken along line IX—IX of FIG. 11.

At the rear end of the lid that will overlie the end wall 4 of the container, FIG. 9, the lid is provided with a plurality of lid hooks 21 extending in one piece from the lid, specifically coplanar with the central portion 18 outwardly beyond the vertical flanges 19 to extend beneath the container flange 11 in the locked position. These hooks 21 may be eliminated if desired. The horizontal lid flange 16 is provided with a plurality of aligned through security apertures 22 that may be conventional and are preferably of triangular or truncated triangular shape. These apertures 22, in the locked position, align vertically with correspondingly shaped apertures 23 in the flange 11 of the container adjacent the end wall 4. In the locked position, a security tie is passed through these aligned apertures 22, 23. Security ties may be of many different known or similar types, for example a strap, a lock, or a rivet. Preferably a rivet type is employed that is provided with a top head, a shank passing through the apertures 22, 23 and of identical external dimensions with the internal dimensions of the apertures 22, 23 and a closely fitting bottom head, with a rivet not being shown. This will prevent any horizontal or vertical movement between the flanges 11, 16. The security tie and security apertures may be of a conventional type. Because of the security tie and apertures 22, 23, the hook is not essential. As shown in FIG. 9, the outer edge of the flange 11 is provided with a downwardly extending flange 24.

On opposite sides 5, 6 of the container, the horizontal flanges 8, 9, at their outer edge, are provided with downwardly extending reinforcing vertical flanges 25. Similarly, the side flanges 13, 14 of the lid are provided at their outer edges with downwardly extending side flanges 26.

Figure 15:
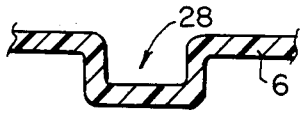
FIG. 15 is a partial cross-sectional view taken on line XV—XV of FIG. 13.
Figure 13:
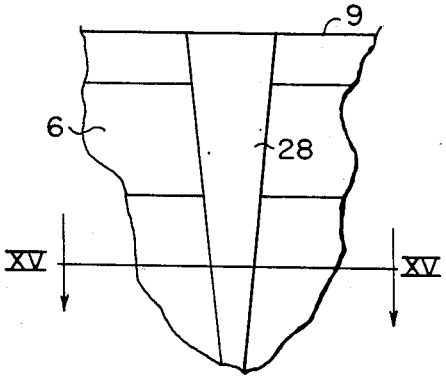
FIG. 13 is an elevational view of the inside of a wall portion.
Figure 14:
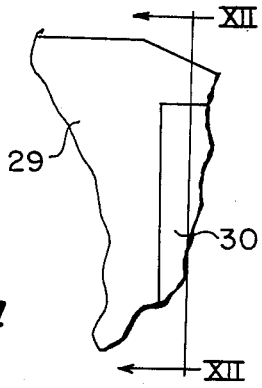
FIG. 14 is a partial elevational view of an end of one of the partitions.
Figure 12:
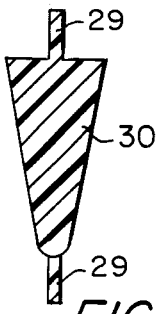
FIG. 12 is a partial cross-sectional view taken on line XII—XII in FIG. 14.
Figure 8:
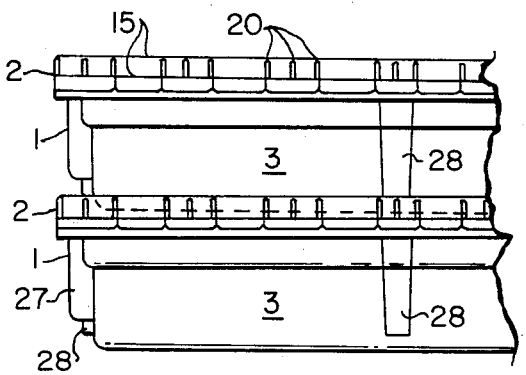
FIG. 8 is an end elevational view, partially broken away, of two stacked and lidded boxes.

Between the end walls 3, 4, 5, 6 of the container and the flanges 10, 11, 8, 9, 25, there may be provided a plurality of vertically extending solid reinforcing ribs or buttresses 27 as shown in FIGS. 2, 4, 6, 7. Also, a plurality of similar buttresses 28 are provided, but such buttresses 28 are hollow as shown in FIGS. 13 and 15 and open inwardly of the box to provide vertical slots along the inner portions of side walls 3, 4 and the end walls 5, 6. Removable partitions 29 have their outer ends received in these slots, preferably in a wedging manner, to partition the interior of the box as shown in FIG. 13. These slots 28 are of decreasing width in the downward direction. The end portion of each of the partitions 29 has a wedge member 30 that is wedgingly received within the correspondingly shaped slot 28. In this manner, the partitions are tightly held in place.

In its locked position, the lid cooperates with the container to provide a circuitous route from the exterior to the interior to prevent the withdrawal of papers. For example at the sides, the lid flanges 26, 13, 14 and 19 present side downwardly opening channels into which telescope the upper portions of the side walls 5, 6 and which permit the relative sliding motion horizontally between the lid and container when moving from the closed position to the locked position. At the rear end wall, particularly as seen in FIG. 9, the flanges 11 and 16 are close to each other. Cut outs are provided in the top portion of the rear end wall 4 to permit passage of the hook 21, and these cut outs are protected by flange 24 from access. The flanges 11, 16 have almost no movement relative to each other due to the tight engagement of the tires within the apertures 22, 23. The container flanges 8, 9 and 11 are all at the same height, that is they are substantially coplanar. The lid flanges 13, 14, 15' and 16 are correspondingly coplanar. The lid flanges 13, 14 and 16 generally engage the corresponding container flanges 8, 9 and 11.

In FIG. 10, the container flange 10 is at a height considerably lower than the container flanges 8, 9 and 11. Correspondingly, the lid flange 15'' is lower, by the same amount, than the lid flanges 15', 13, 14 and 16. Thus, the flanges 15'' and 10 substantially engage each other. The lid flange 15'' is lower than the lid central portion 18, the container is provided with a vertical ambutment flange 32 whose outside surface will engage the inside surface of the vertical lid flange 15''' to held provide a circuitous path to the interior of the box when the lid is in the locked position. The difference in height between the lid central portion 18 and the lid flange 15'' is preferably equal to the height of the abutment flange 32. To further provide a circuitous route to the interior of the box, the lid is provided with a skirt flange 33 that extends vertically adjacent the container skirt flange 34 in the locked position. The skirt flange 34 is interrupted to provide notches 35 defined by the flange 10 and to provide notch flanges 36 that extend from the skirt flange 34 parallel to the side walls to the front end wall 3 for enforcement. A plurality of lid hooks 37 have a horizontal leg portion 38 that is of a width substantially equal to the width of the notches 35 and of a length substantially equal to the length of the flanges 36 to underlie the flange 10 in the locked position. The hooks 37 have a vertical leg 39 integrally and strongly connected to the horizontal leg 38, which vertical leg 39 will effectively close the notch area 35. The vertical leg 39 is coplanar with the lid skirt flange 33 and connected thereto by weakened portions 40. The weakened portions 40 are the only connection between the hooks 37 and remainder of the lid. The weakened portions are particularly formed by vertically extending V-shaped notches as indicated.

These weakened portions 40 are such that with the lid in its locked position and secured at the rear end by security ties through apertures 22, 23, the front end cannot be "unzipped" without breaking the weakened portions 40. Thus, the weakened portions 40 provide a tamper indicator that would indicate if the lid and container were attempted to be forced apart with a force sufficiently great that unzipping would be successful were it not for the weakened portions 40. It is particularly desirable to have the weakened portions between the vertical leg 39 and the skirt portion 33, so that the entire hook, 38, 39 will be broken off to provide a readily viewable tamper indicator, particularly which is viewable from the top or from the end of the box.

While a weakened portion only in between the legs 38, 39 would function, it would not be as desirable because the tamper indicator could only be viewed from the bottom of the box and tampering would not be so obvious. From the preferred embodiment, there are six such notches 35 and hooks 37 along the front end wall. It is not necessary to have any security ties at the front end wall, because of the lid hook structure. Preferably, the width of the skirt flange 34 between the notches 35 is substantially equal to the width of the notches 35 and hooks 37. The buttresses 20 extend only in the area of the skirt portions 33 between the hooks 37.

Preferably, the lid is transparent to permit viewing of documents within the box and to make tampering more visible.

Further objects, features and advantages together with modifications and further embodiments are all contemplated according to the spirit and scope of the present invention, as fully defined by the following claims.

What is claimed is:

1. In a security storage box for papers of a similar size, such as checks, having:

a one-piece molded synthetic resin open-topped container having opposed generally parallel side walls, opposed generally parallel end walls, and a rectangular bottom wall;

the upper edge portions of said side and end walls including integrally formed outwardly extending horizontal flanges connected together around substantially the entire upper periphery of said container to constitute container side and end flanges, said container side flanges having a plurality of through container side apertures;

a lid separate from said container and integrally molded from synthetic resin in one piece, said lid being of a size and a rectangular shape to close the open top of said container, said lid having a peripheral lid flange overlying said container flanges, said lid integrally being formed with a plurality of lid side hooks depending in one piece in alignment with and to extend through said through container side apertures;

said lid hooks and through container side apertures being of a size and shape so that in a disengaged position, said lid may be translated vertically downward to a closed position on said container with said lid side hooks extending completely through said container apertures and thereafter translated horizontally parallel to said side walls to a locked position to engage said lid side hooks beneath said container side flanges;

said lid integrally being formed with end lid hooks extending in one piece from each end and extending beneath said container end flanges when said lid is translated horizontally from said closed position to said locked position;

at least one pair of aligned through security apertures, respectively extending vertically through the container flange on one end wall and an adjacent portion of said lid flange for constituting lock means to receive a security tie and secure said lid and container against horizontal translation from said locked position to said closed position; and the improvement comprising at least one end lid hook extending beneath one of said container end flanges along one of said end walls having means for breaking said end lid hook off of said lid and providing a tampering indicator if said lid and said container are forced apart by a prying force exerted between said lid and said container along said one end wall without moving said lid as a whole in translational movement from said locked position to said closed position, said breaking means further remaining integral with said lid end when said lid is moved as a whole in translational movement from said locked position to said closed position.

2. The box according to claim 1, wherein said means for breaking are weakened portions connecting said lid hook with the remainder of said lid.

3. The box according to claim 2, wherein said weakened portions are notch sensitive areas assuming substantially the full dimension of the integral transition from said end lid hook to the remainder of said lid.

4. The box according to claim 3, wherein each of said one end lid hooks has a cantilevered horizontal leg extending beneath the adjacent flange of the container and a vertically extending flange, said notch sensitive areas providing the only connection between said one end lid hooks and the remainder of said lid, and said notch sensitive areas are vertical and only between said vertical leg and the remainder of said lid.

5. The box according to claim 4, wherein said notch sensitive areas are V-shaped.

6. The box according to claim 4, wherein said vertical leg extends to the outside of said container and said horizontal leg is cantilevered inward with respect to said container, so that said vertical leg is clearly visible from the front and above the box when in its locked position to provide a tamper indicator when broken off.

7. The box according to claim 2, wherein said one end lid hook includes a vertical leg portion and a horizontal leg portion, and said weakened portions connecting said vertical leg portion to the remainder of said lid so that breaking off of said one end lid hook is visible from above and the front of said box.

8. The box according to claim 7, wherein said lid is transparent, and said container is opaque to provie indicator means of tampering by making the breaking off of said one end lid hook more visible.

9. The box according to claim 7, wherein the lid has outer side flanges overlapping the container to provide downwardly opening side channels telescopically receiving therein the upper edge of the container side walls.

10. The box according to claim 2, wherein said security apertures and lock means are at the end of said box opposite from said one end having the weakened portions.

11. The box according to claim 10, wherein said lock means and security apertures prevent any relative movement between the adjacent portions of said lid and container.

12. The box according to claim 1, further comprising said container having a vertically extending skirt flange integrally formed along said one end wall with said horizontal end flange and extending downwardly therefrom, said skirt flange having notches positioned adjacent each said end lid hook; and each said end lid hook having a horizontal leg portion having a width substantially equal to that of the corresponding one of said notches such that said horizontal leg portion of each of said end lid hooks extends into a corresponding one of said notches when said lid is translated from said closed position to said locked position.

13. The box according to claim 12 further comprising said lid having a lid skirt flange integrally formed with said peripheral lid flange, said horizontal leg portion of each said end lid hook being integrally formed with said skirt flange and extending inwardly toward said one end wall; and said breaking means being weakened portions extending vertically along said lid skirt flange adjacent each side of said end lid hooks such that said horizontal leg portion and said lid skirt portion extending between said vertically extending weakened portions for each end lid hook break off together to provide the tampering indication that is visible from the bottom, top, and said one end wall of the box.

* * * * *